US011208967B1

(12) United States Patent
Dölker

(10) Patent No.: US 11,208,967 B1
(45) Date of Patent: Dec. 28, 2021

(54) METHOD FOR OPERATING AN INTERNAL COMBUSTION ENGINE HAVING AN INJECTION SYSTEM, INJECTION SYSTEM DESIGNED TO CARRY OUT A METHOD OF THIS TYPE, AND INTERNAL COMBUSTION ENGINE HAVING AN INJECTION SYSTEM OF THIS TYPE

(71) Applicant: MTU FRIEDRICHSHAFEN GMBH, Friedrichshafen (DE)

(72) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 213 days.

(21) Appl. No.: 16/635,397

(22) PCT Filed: Aug. 7, 2018

(86) PCT No.: PCT/EP2018/071435
§ 371 (c)(1),
(2) Date: Jan. 30, 2020

(87) PCT Pub. No.: WO2019/030245
PCT Pub. Date: Feb. 14, 2019

(30) Foreign Application Priority Data

Aug. 10, 2017 (DE) ..... 10 2017 214 001.1

(51) Int. Cl.
*F02D 41/38* (2006.01)
*F02M 63/02* (2006.01)

(52) U.S. Cl.
CPC ..... *F02D 41/3845* (2013.01); *F02D 41/3863* (2013.01); *F02M 63/025* (2013.01)

(58) Field of Classification Search
CPC ..... F02D 2041/1432; F02D 2200/0602; F02D 2250/04; F02D 41/3845; F02D 41/3863; F02M 63/025
See application file for complete search history.

(56) References Cited

U.S. PATENT DOCUMENTS 9,249,753 B2 2/2016 Viereck
9,441,572 B2 * 9/2016 Dolker ..... F02D 41/3863
(Continued)

FOREIGN PATENT DOCUMENTS

DE 10112702 A1 10/2002
DE 102010043755 A1 5/2012
(Continued)

*Primary Examiner* — George C Jin
*Assistant Examiner* — Teuta B Holbrook
(74) *Attorney, Agent, or Firm* — Lucas & Mercanti, LLP; Klaus P. Stoffel

(57) ABSTRACT

A method for operating an internal combustion engine having an injection system which has a high-pressure accumulator, high pressure in the high-pressure accumulator being controlled via a suction throttle on the low-pressure side, acting as a first pressure control element in a first high-pressure control loop. During normal operation, a high-pressure disturbance variable is produced by a pressure regulating valve on the high-pressure side, acting as an additional pressure control element, via which fuel is re-directed from the high-pressure accumulator into a fuel reservoir, the at least one pressure regulating valve being controlled, during normal operation, based on a set volumetric flow rate for the fuel to be re-directed. A temporal development of the set volumetric rate is sensed and the set volumetric flow rate is filtered, a time constant for the filtering of the set volumetric flow rate being selected as a function of the sensed temporal development.

13 Claims, 6 Drawing Sheets

(56) References Cited

U.S. PATENT DOCUMENTS

| | | | | |
|---|---|---|---|---|
| 9,556,840 | B2 | 1/2017 | Dölker | |
| 2008/0103674 | A1* | 5/2008 | Kosiedowski | F02D 41/3863 701/103 |
| 2014/0081552 | A1 | 3/2014 | Nieddu | |
| 2017/0067409 | A1 | 3/2017 | Dölker | |
| 2018/0023502 | A1* | 1/2018 | Dolker | F02D 41/22 123/447 |

FOREIGN PATENT DOCUMENTS

| | | | |
|---|---|---|---|
| DE | 102012019457 | B3 | 3/2014 |
| DE | 102014213648 | B3 | 10/2015 |

* cited by examiner

METHOD FOR OPERATING AN INTERNAL COMBUSTION ENGINE HAVING AN INJECTION SYSTEM, INJECTION SYSTEM DESIGNED TO CARRY OUT A METHOD OF THIS TYPE, AND INTERNAL COMBUSTION ENGINE HAVING AN INJECTION SYSTEM OF THIS TYPE

CROSS-REFERENCE TO RELATED APPLICATIONS

The present application is a 371 of International application PCT/EP2018/071435, filed Aug. 7, 2018, which claims priority of DE 10 2017 214 001.1, filed Aug. 10, 2017, the priority of these applications is hereby claimed and these applications are incorporated herein by reference.

The invention concerns a method for operating an internal combustion engine, an injection system for an internal combustion engine set up to carry out such a method, and an internal combustion engine with such an injection system.

From the German patent specification DE 10 2014 213 648 B3 a method for operating an internal combustion engine with an injection system is known, wherein the injection system comprises a high-pressure accumulator, and wherein a high pressure in the high-pressure accumulator is controlled by a low-pressure suction throttle as the first pressure control element in a first high-pressure control circuit. In a normal mode, a high-pressure disturbance variable is generated via a high-pressure pressure control valve, which is used as the second pressure control element, wherein fuel from the high-pressure accumulator is re-directed into a fuel reservoir at low pressure. The pressure control valve is controlled in the normal mode on the basis of a setpoint volumetric flow for the fuel to be re-directed.

If the load is suddenly reduced on such an internal combustion engine operated in such a way, in particular a complete load reduction from a full load state, first the high pressure in the high-pressure accumulator rises, since the amount of fuel to be injected into the internal combustion engine's combustion chambers is quickly cancelled, wherein the high pressure control responds with a delay. However, in this case, the high-pressure disturbance variable, i.e. the setpoint volumetric flow for the fuel to be re-directed via the pressure control valve, is rapidly increased, so that the high pressure decreases again. The setpoint volumetric flow for the fuel to be re-directed is only reduced again after the internal combustion engine has reached its idling speed. This reduction in the setpoint volumetric flow is carried out as rapidly as the previous rapid increase in the setpoint volumetric flow, which is intended to limit the increase of the high pressure directly during the load reduction. However, this rapid, almost sudden reduction in the setpoint volumetric flow has the consequence that—in particular due to the inertia of the high-pressure control—the high pressure in the high-pressure accumulator increases abruptly, which allows the internal combustion engine to be unduly loaded, and wherein the emission behavior of the engine can significantly worsen due to the sudden large deviation of the actual high pressure from a setpoint high pressure.

SUMMARY OF THE INVENTION

The invention is based on the object of creating a method for operating an internal combustion engine, an injection system that is set up to perform such a method, and an internal combustion engine with such an injection system, wherein the aforementioned disadvantages are not encountered.

In particular, the object is achieved by developing the method described above so that a variation with time of the setpoint volumetric flow is detected and so that the setpoint volumetric flow is filtered, wherein a time constant for the filtering of the setpoint volumetric flow is selected depending on the recorded variation with time of the setpoint volumetric flow. The at least one pressure control valve is controlled with the filtered setpoint volumetric flow. As a result, it is possible to influence the dynamics of the variation with time of the setpoint volumetric flow depending on the present variation with time, so that in particular different time constants can be selected for different variations with time of the setpoint volumetric flow. In particular, the setpoint volumetric flow can be delayed, reduced or reversed, so that an excessive increase in the high pressure, which can result in a significant worsening of the emission behavior of the internal combustion engine and an undue load on the internal combustion engine, can be avoided. Furthermore, the variation with time of the setpoint volumetric flow can be rapid and in particular highly dynamic if this is necessary to protect the internal combustion engine from an undue load, in particular in order to prevent an unacceptable increase in the high pressure by rapidly increasing the setpoint volumetric flow. However, these high dynamics of the setpoint volumetric flow are no longer mandatory for any variation with time thereof but can rather be delayed for such events in which, for example, an excessively rapid reversal of the setpoint volumetric flow would result in an unacceptable high-pressure increase in the high-pressure storage tank. In this way, the internal combustion engine is protected from an unduly high load, and degraded emission behavior of the internal combustion engine can be effectively avoided at appropriate operating points or in the event of corresponding operating events. This results in a longer service life of the injection system and also of the internal combustion engine as a whole, as well as in globally improved emission behavior.

The injection system of the internal combustion engine comprises at least one first high-pressure pressure control valve as a further pressure control element. It is therefore possible according to one embodiment that the injection system comprises only one and exactly one high-pressure pressure control valve. However, according to a different design, it is also possible that the injection system comprises a plurality of high-pressure pressure control valves as further pressure control elements, wherein it may in particular comprise exactly two pressure control valves on the high-pressure side as further pressure control elements.

The injection system is specifically designed to inject fuel into at least one combustion chamber of the internal combustion engine, in particular for direct injection of fuel into at least one combustion chamber, and in particular for the injection of fuel into a plurality of combustion chambers of the internal combustion engine, in particular for direct injection of fuel into each combustion chamber of the plurality of combustion chambers.

The high-pressure accumulator system is preferably embodied as a common high-pressure accumulator, with which a plurality of injectors is in fluid connection. The individual injectors may be assigned in particular to different combustion chambers of the internal combustion engine for direct injection of fuel into the respective combustion chambers. Such a high-pressure accumulator is also referred to as a rail, wherein the injection system is preferably embodied as a common-rail injection system.

In particular, a volumetric fuel flow that can be conveyed from the fuel reservoir into the high-pressure accumulator can be adjusted via the suction throttle on the low-pressure side, so that the high pressure is controlled by the first high pressure control circuit by varying the amount of fuel fed to the high-pressure accumulator per unit of time. By means of the at least one high-pressure pressure control valve, fuel can be re-directed from the high-pressure accumulator into the fuel reservoir, so that the pressure control valve can be used in particular to prevent an unacceptable increase in the high pressure and/or to reduce the high pressure quickly.

According to a development of the invention, it is provided that a time derivative of the setpoint volumetric flow is calculated, wherein the time constant for the filtering applied to the setpoint volumetric flow is selected depending on the time derivative. In particular, by choosing the time constant depending on the time derivative, the dynamics of the setpoint volumetric flow can be influenced depending on its variation with time. Preferably, an averaged time derivative of the setpoint volumetric flow is calculated, wherein the time constant is selected depending on the averaged time derivative. This increases the reliability of the method, as the choice of time constant is then influenced by singular outliers to a lesser extent, wherein the general trend of the variation with time of the setpoint volumetric flow can be more precisely detected.

According to a development of the invention, it is provided that a first time constant is selected if the—preferably averaged—time derivative has a positive sign or is equal to zero, wherein a second time constant that is different from the first time constant is selected if the—preferably averaged—time derivative of the volumetric flow has a negative sign. The fact that the time derivative has a positive sign or is equal to zero means in particular that it is really positive or zero, is in particular greater than or equal to zero. The fact that the time derivative has a negative sign means in particular that it is really negative, i.e. less than zero. According to this design of the method, the choice of the time constant, i.e. the choice of a value for the time constant, can be made dependent on whether the setpoint volumetric flow increases or decreases. In this way, for an increase in the setpoint volumetric flow, another, preferably smaller time constant may be selected than for a decrease in the setpoint volumetric flow. Thus, it is possible that the setpoint volumetric flow can increase rapidly in order to avoid an unacceptable increase of the high pressure or to reduce the high pressure quickly, wherein on the other hand a reduction of the setpoint volumetric flow can be delayed in order to avoid an undue increase in the high pressure in the high-pressure accumulator in this case.

According to one development of the invention, it is provided that the first time constant is equal to zero. This advantageously allows filtering of the setpoint volumetric flow in the event of an increase thereof, which returns the same setpoint volumetric flow as the result, which thus has the same effect as if the setpoint volumetric flow is not filtered. This can therefore increase in a highly dynamic and non-delayed manner in order to rapidly remove fuel from the high-pressure accumulator and thus avoid an unacceptable increase in high pressure or reduce the high pressure rapidly. The second time constant is preferably greater than zero, i.e. especially truly positive. If the setpoint volumetric flow decreases, this decrease can therefore be due to the truly positive second time constant, wherein in particular the control of the pressure control valve in the closing direction is delayed. This can prevent or at least reduce an unacceptable increase in the high pressure when the setpoint volumetric flow is reversed.

According to one development of the invention, it is provided that the second time constant is from at least 0.1 seconds to a maximum of 1.1 seconds, preferably from at least 0.2 seconds to a maximum of 1 second. It has been found that these values are particularly suitable for the second time constant to avoid an unacceptable increase of the high pressure in the high-pressure accumulator by closing the pressure control valve.

According to one development of the invention, it is provided that the setpoint volumetric flow is filtered with a proportional filter with a delay element, in particular with a $PT_1$ algorithm. This design has proven to be a particularly effective filtering of the setpoint volumetric flow in order to achieve the advantages mentioned here.

According to one development of the invention, it is provided that the high pressure is controlled in a first mode of operation of a protection mode using at least one pressure control valve by means of a second high pressure control circuit. This provides in particular a redundancy in the control of the high pressure, wherein even in the event of a failure of the first high pressure control circuit—in particular in the event of a failure of the suction throttle as the first pressure control element, for example due to a cable breakage, a forgotten plug-in of a suction throttle plug, clamping or contamination of the suction throttle, or another fault or defect in the first high pressure control circuit—control of the high pressure is still possible, namely via the second high pressure control circuit and by means of the at least one pressure control valve. A deterioration in the emission behavior of the internal combustion engine can thus be avoided.

Alternatively or additionally, it is preferably provided that in a second operating mode of the protection mode at least one second high-pressure pressure control valve, which is different from the at least one first high-pressure pressure control valve, is controlled in addition to the at least one first pressure control valve as a pressure control element for controlling the high pressure. The second pressure control valve is arranged in particular in relation to flow in parallel with the first pressure control valve, wherein both pressure control valves—in the parallel connection—connect the high-pressure accumulator to the fuel reservoir, and wherein fuel from the high-pressure accumulator can be re-directed into the fuel reservoir via both pressure control valves. Especially in operating situations in which at least one first pressure control valve is no longer sufficient for a functioning high-pressure control, so that the high pressure continues to increase despite the control of at least one first pressure control valve, it is then possible in the second operating mode of the protection operation to switch on at least one second pressure control valve, so that the pressure control valves are now controlled in common as pressure control elements for pressure control of the high pressure. This enables greater re-direction amounts to be achieved, so that efficient and safe pressure control is possible even with higher re-direction requirements. In this case, the at least one second pressure control valve is also preferably controlled by the second-high pressure control circuit—as well as the at least one first pressure control valve.

Alternatively or additionally, it is preferably provided that in a third operating mode of the protection mode, at least one pressure control valve is permanently opened. Particularly preferably, in the third operating mode of the protection mode all pressure control valves, in particular the at least one first pressure control valve and the at least one second pressure control valve, are permanently opened. In this third operating mode, a large volumetric fuel flow can be permanently re-directed from the high-pressure accumulator into the fuel reservoir via the pressure control valves. The pressure control valves are preferably controlled towards a maximum opening, so that a maximum volumetric fuel flow can be re-directed via the pressure control valves. As a result, an unacceptably high pressure in the high-pressure accumulator can be decreased not only temporarily, but permanently, quickly and reliably, so that the injection system is effectively and reliably protected. This functionality makes it possible, in particular, to dispense with a mechanical overpressure valve, so that space and costs can be saved. The functionality of the mechanical overpressure valve is simulated by the control of at least one pressure control valve in this case.

Preferably, the first operating mode of the protection mode is selected if the high pressure reaches or exceeds a first pressure limit value, or if a defect of the suction throttle is detected. Alternatively or additionally, the second protection mode is selected if the high pressure reaches or exceeds a second pressure limit value. Alternatively or additionally, the third operating mode of the protection mode is selected if the high pressure reaches or exceeds a third pressure limit value, or if a defect of a high pressure sensor is detected. The third pressure limit value is preferably chosen to be larger than the second pressure limit value. Preferably, the third pressure limit value is chosen to be greater than the first pressure limit value. Preferably, the second pressure limit value is chosen to be greater than the first pressure limit value. Particularly preferably, the second pressure limit value is chosen to be greater than the first pressure limit value, wherein the third pressure limit value is selected to be greater than the second pressure limit value. For example, it is possible that the first pressure limit value is selected at 2400 bar, wherein the third pressure limit value may be 2500 bar. The second pressure limit value is preferably selected between the first pressure limit value and the third pressure limit value.

In at least one operating mode of the protection mode, the suction throttle is preferably controlled to a permanently opened position. Preferably, the suction throttle is controlled to a permanently opened position in particular or only in the third operating mode of the protection mode. This allows sufficient fuel delivery into the high-pressure accumulator even when the at least one pressure control valve is permanently open, so that the internal combustion engine is not choked. The suction throttle is permanently opened in the third operating mode, especially in a kind of emergency operation, in order to ensure that even in the medium and low speed range of the internal combustion engine there is still enough fuel in the high-pressure accumulator in order to maintain the operation of the internal combustion engine.

The object is also achieved by creating an injection system for an internal combustion engine, which at least one injector, a high-pressure accumulator, which has a fluid connection on the one hand to at least one injector and on the other hand via a high-pressure pump to a fuel reservoir, wherein the high-pressure pump is assigned a suction throttle as the first pressure control element, and is created with a pressure control valve, via which the high-pressure accumulator system has a fluid connection to the fuel reservoir. The injection system comprises a control unit that has a working connection to at least one injector, the suction throttle and at least one pressure control valve. The control unit is set up to perform a method according to one of the embodiments described above. In particular, the advantages already explained in connection with the method are realized in connection with the injection system.

Preferably, the injection system comprises a plurality of injectors, wherein it comprises exactly one and only one high-pressure accumulator system, to which the various injectors are fluidically connected. In this case, the common high-pressure accumulator is formed as a so-called common rail, in particular as a rail, wherein the injection system is preferably embodied as a common-rail injection system.

The suction throttle is connected before the high-pressure pump, in particular in terms of flow, i.e. is arranged upstream of the high-pressure pump. It is possible that the suction throttle is integrated into the high-pressure pump or into a housing of the high-pressure pump. A low-pressure pump is preferably arranged upstream of the high-pressure pump and the suction throttle to convey fuel from the fuel reservoir to the suction throttle and the high-pressure pump.

A pressure sensor is preferably arranged on the high-pressure accumulator, which is used to detect a high pressure in the high-pressure accumulator and which has a working connection to the control unit, so that the high pressure can be registered in the control unit.

The control unit is preferably designed as an engine control unit (ECU) of the internal combustion engine. Alternatively, it is also possible that a separate control unit is provided specifically for carrying out the method.

An exemplary embodiment of the injection system is preferred, in which the pressure control valve is fully open. This design has the advantage that the pressure control valve opens to the maximum width when it is not controlled or energized, which enables particularly safe and reliable operation, especially when a mechanical overpressure valve is dispensed with. An unacceptable increase in the high pressure in the high-pressure accumulator can also be avoided if it is not possible to energize the pressure control valve due to a technical fault.

The object is finally achieved by creating an internal combustion engine that has an injection system according to a previously described initial example. The advantages already explained in connection with the injection system and the method arise in particular in connection with the internal combustion engine.

BRIEF DESCRIPTION OF THE DRAWING

The invention is explained in more detail below on the basis of the drawing. In the figures.

DETAILED DESCRIPTION OF THE INVENTION

Figure 1:
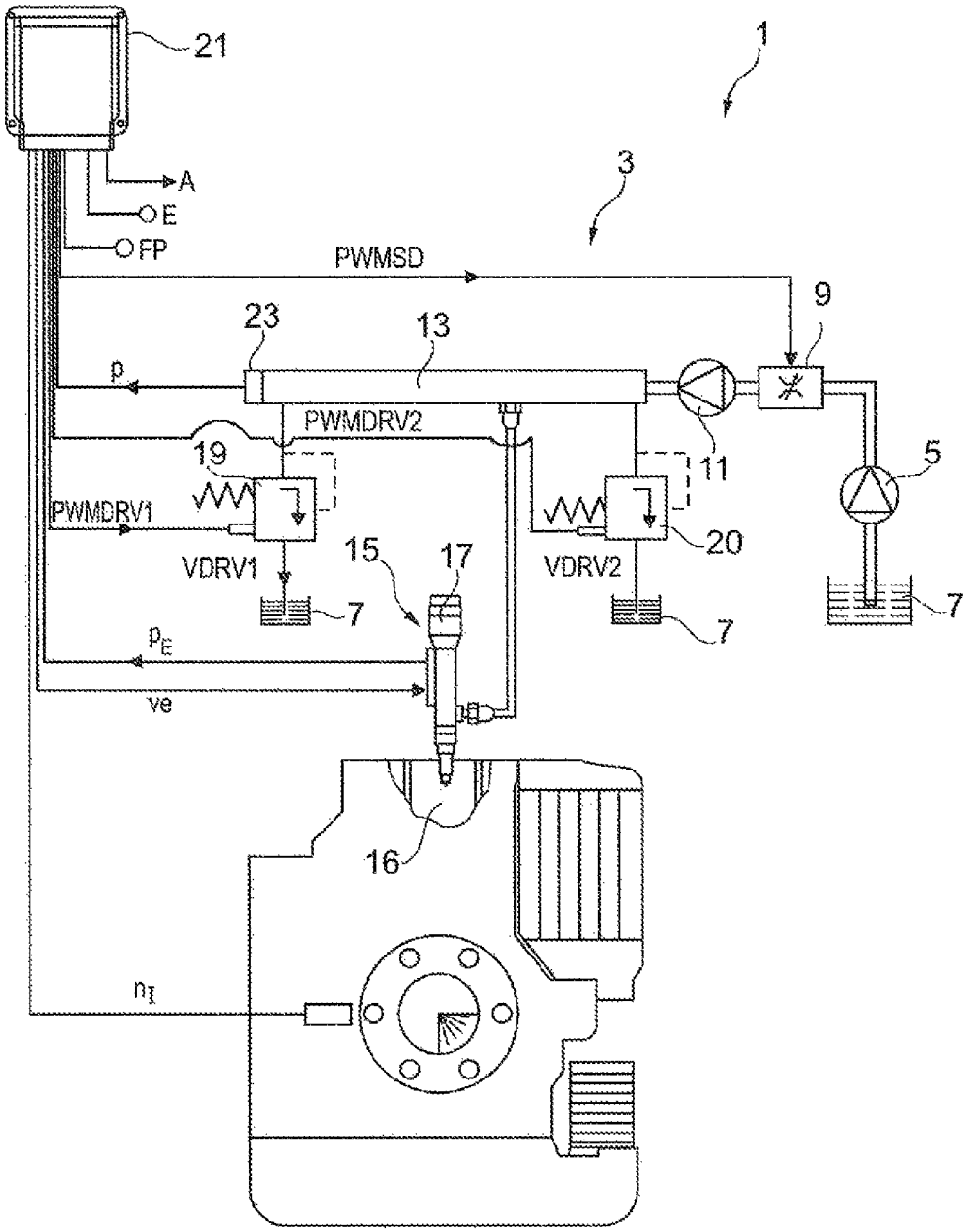
FIG. 1 shows a schematic representation of a first initial example of an internal combustion engine with an injection system.

FIG. 1 shows a schematic representation of an embodiment of an internal combustion engine 1 that comprises an injection system 3. This is preferably designed as a common-rail injection system. It comprises a low-pressure pump 5 for conveying fuel from a fuel reservoir 7, an adjustable, low-pressure suction throttle 9 for influencing a volumetric fuel flow flowing through it, a high-pressure pump 11 for conveying the fuel under increased pressure into a high-pressure accumulator 13, the high-pressure accumulator 13 for storing the fuel, and a plurality of injectors 15 for injecting the fuel into combustion chambers 16 of the internal combustion engine 1. Optionally, it is possible that the injection system 3 is implemented with single accumulators, wherein then for example, a single accumulator 17 is integrated within the injector 15 as an additional buffer volume. A first, in particular electrically controllable high-pressure pressure control valve 19 is provided, via which the high-pressure accumulator system 13 has a flow connection to the fuel reservoir 7. The position of the first pressure control valve 19 defines a volumetric fuel flow that is re-directed from the high-pressure accumulator system 13 into the fuel reservoir 7. This volumetric fuel flow is designated in FIG. 1 by VDRV1 and constitutes a high-pressure disturbance variable of the injection system 3.

According to an exemplary embodiment that is not illustrated of the internal combustion engine 1, it is possible that this comprises only the first and thus the only pressure control valve 19.

The injection system 3 in the exemplary embodiment shown here, however, comprises a second, in particular electrically controllable high-pressure pressure control valve 20, via which the high-pressure accumulator 13 is also fluidically connected to the fuel reservoir 7. The two pressure control valves 19, 20 are therefore arranged in particular in parallel with each other in terms of flow. A volumetric fuel flow that can be re-directed from the high-pressure accumulator 13 into the fuel reservoir can also be defined via the second pressure control valve 20. This volumetric fuel flow is designated in FIG. 1 by VDRV2.

The injection system 3 preferably does not comprise a mechanical overpressure valve, which is conventionally provided and then connects the high-pressure accumulator 1 to the fuel reservoir 7. The mechanical overpressure valve can be dispensed with, since its function is completely taken over by at least one pressure control valve 19, 20. However, it is also possible to design the injection system 3 with at least one mechanical overpressure valve, whereby an additional safety measure may be provided to avoid an unacceptable increase of the high pressure in the high-pressure accumulator system 13.

It is possible that the injection system 3 comprises more than two pressure control valves 19, 20. For a simpler presentation, however, the manner of operation of the injection system 1 is in particular explained below on the basis of the exemplary embodiment shown here, which comprises exactly two pressure control valves 19, 20.

The operating mode of the internal combustion engine 1 is determined by an electronic control unit 21, which is preferably designed as the engine control unit of the internal combustion engine 1, namely as a so-called Engine Control Unit (ECU). The electronic control unit 21 contains the usual components of a microcomputer system, such as a microprocessor, I/O modules, buffers and memory modules (EEPROM, RAM). In the memory modules, the operating data relevant for the operation of the internal combustion engine 1 are applied in characteristic fields/characteristic curves. The electronic control unit 21 calculates input variables and output variables from these. In FIG. 1, the following input variables are shown as examples: A measured, still unfiltered high pressure p, which prevails in the high-pressure accumulator 13 and which is measured by means of a high pressure sensor 23, a current engine speed $n_I$, a signal FP for a performance specification by an operator of the internal combustion engine 1, and an input variable E. The input variable E preferably combines further sensor signals, for example, a charge air pressure of an exhaust turbocharger. In an injection system 3 with individual accumulators 17, a single storage pressure $p_E$ is preferably an additional input variable of the control unit 21.

In FIG. 1, examples of the output variables of the electronic control unit 21 are a signal PWMSD for controlling the suction throttle 9 as a pressure control element, a signal ve for controlling the injectors 15—which specifies in particular a start of injection and/or an end of injection or even a duration of injection—, a first signal PWMDRV1 for controlling a first pressure control valve of the two pressure control valves 19, 20, and a second signal PWMDRV2 for controlling a second pressure control valve of the two pressure control valves 19, 20 shown. The signals PWMDRV1, PWMDRV2 are preferably pulse-width modulated signals, by means of which the position of a pressure control valve 19, 20 and thus the volumetric fuel flow VDRV1, VDRV2 respectively assigned to the pressure control valve 19, 20 can be defined.

It is understood that in the previously described exemplary embodiment, in which the injection system 3 comprises only one pressure control valve 19, 20, also only one signal PWMDRV for controlling the pressure control valve is generated and output by the control unit 21. Also, this one signal PWMDRV is preferably formed as pulse-width modulated signal, by means of which the position of the pressure control valve 19, 20 and thus the volumetric fuel flow VDRV associated with the pressure control valve 19, 20 can be defined.

In FIG. 1, moreover, another output variable A is also shown, which represents further control signals for the control and/or regulation of the internal combustion engine 1, for example for an activation signal for activating a second exhaust gas turbocharger in the event of turbocharging.

Figure 2:
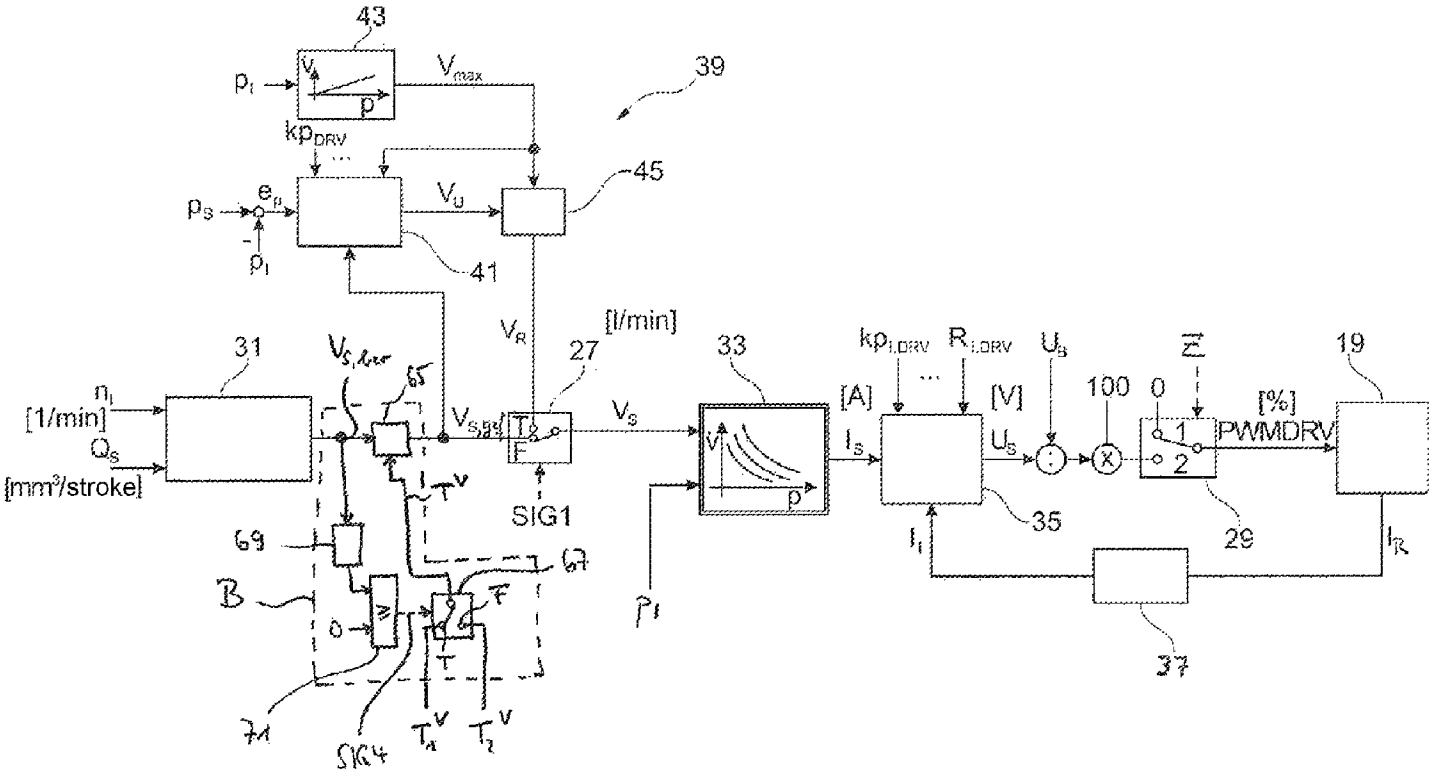
FIG. 2 shows a schematic detailed representation of a first embodiment of the method.

FIG. 2 shows a first detailed schematic representation of a first embodiment of the method. The explanation of the manner of operation of the injection system 3 is initially carried out without taking into account the dashed function block B, whereby in particular first, a function of the injection system 3 is described without the function block B for a better understanding of this function as well as the purpose and function of function block B. A first high pressure control circuit that is not shown is provided, by means of which the high pressure in the high-pressure accumulator system 13 is controlled during the normal mode of the injection system 3 by means of the suction throttle 9 as the first pressure control element. The first high pressure control circuit has a setpoint high pressure $p_S$ for the injection system 3 as the input variable. This is preferably read from a characteristic field, preferably as a function of a speed of the internal combustion engine 1, a load or a torque requirement to the internal combustion engine 1 and/or as a function of other, in particular correction variables. Further input variables of the first high pressure control circuit are in particular a measured speed $n_I$ of the internal combustion engine 1 as well as a setpoint injection quantity $Q_S$ preferably also read out from a characteristic field and/or resulting from a speed controller for the internal combustion engine 1. As the output variable, the first high pressure control circuit has in particular an actual high pressure $p_I$, which is obtained from the high pressure p measured by the high pressure sensor 23, in that this is preferably subjected to first filtering with a larger time constant, wherein at the same time it is preferably subjected to second filtering with a smaller time constant to calculate a dynamic rail pressure $p_{dyn}$ as a further output variable of the first high pressure control circuit.

In FIG. 2, the control of the one pressure control valve 19 of an embodiment of the injection system 3 with exactly one pressure control valve 19 is illustrated. A first switching element 27 is preferably provided, with which the mode can be switched between the normal mode and a first operating mode of a protection mode depending on a first logic signal SIG1. Preferably, the switching element 27 is entirely implemented on an electronic or software level—as are preferably all the switching elements described below. Here, the functionality described below is preferably switched depending on the value of a variable corresponding to the first logic signal SIG1, which is formed in particular as a so-called flag and can assume the values "true" or "false". Alternatively, however, it is of course also possible that the switching element 27 is embodied as a real switch, for example as a relay. This switch can then be switched, for example, depending on a level of an electrical signal. In the configuration shown here, the normal mode is set if the first logic signal SIG1 has the value "false". On the other hand, the first operating mode of the protection operation is set when the first logic signal SIG1 has the value "true".

A second switching element 29 is provided, which is set up to switch the control of the pressure control valve 19 from a normal function to a standstill function and back. The second switching element 29 is controlled depending on a second logic signal Z or the value of a corresponding variable. The second switching element 29 may be designed as a virtual, in particular software-based, switching element, which switches between the normal function and the standstill function depending on the value of a variable designed in particular as a flag. Alternatively, it is also possible that the second switching element 29 can be used as a real switch, for example as a relay that switches depending on a signal value of an electrical signal. Here, the second logic signal Z specifically corresponds to a state variable, which can assume the value 1 for a first state and the value 2 for a second state. The normal function is set for the pressure control valve 19 when the second logic signal Z takes the value 2, wherein the standstill function is set when the second logic signal Z takes on the value 1. Of course, a different definition of the second logic signal Z is possible, in particular in such a way that a corresponding variable can assume the values 0 and 1.

First, control of the pressure control valve 19 in the normal mode is now described as well as in the case of the normal function. A calculation element 31 is provided, which outputs a calculated setpoint volumetric flow $V_{S,ber}$ as the output variable, wherein the current speed $n_I$, the setpoint injection quantity $Q_S$, moreover the setpoint high pressure $p_S$ preferably in a way that is not explicitly shown here, the dynamic rail pressure $p_{dyn}$, and the actual high-pressure $p_I$ are entered into the calculation element 31 as input variables. The manner of operation of the calculation element 31 is described in detail in the German patent specifications DE 10 2009 031 528 B3 and DE 10 2009 031 527 B3. In particular, it can be shown that in a low load range, for example when the internal combustion engine 1 is idling, a positive value for a static setpoint volumetric flow is calculated, while in a normal operating range a static setpoint volumetric flow of 0 is calculated. The static setpoint volumetric flow is preferably corrected by adding up a dynamic setpoint volumetric flow, which in turn is calculated by means of a dynamic correction depending on the setpoint high pressure $p_S$, the actual high pressure $p_I$ and the dynamic rail pressure $p_{dyn}$. The calculated setpoint volumetric flow $V_{S,ber}$ is finally the sum of the static setpoint volumetric flow and the dynamic setpoint volumetric flow. The calculated setpoint volumetric flow $V_S$ is a resultant setpoint volumetric flow in this respect.

In the normal mode, if the first logic signal SIG1 has the value "false",—as first mentioned when ignoring function block B—the calculated setpoint volumetric flow $V_S$ is transferred unchanged as the setpoint volumetric flow $V_S$ to a pressure control valve characteristic field 33. Here the pressure control valve characteristic field 33—as described in the German patent specification DE 10 2009 031 528 B3—represents an inverse characteristic of the pressure control valve 19. The output variable of this pressure control valve characteristic field 33 is a pressure control valve setpoint current $I_S$, wherein the input variables are the setpoint volumetric flow $V_S$ and the actual high pressure $p_I$.

The pressure control valve setpoint current $I_S$ is fed to a current controller 35, which has the task of regulating the current for controlling the pressure control valve 19. Further input variables of the current controller 35 are, for example, a proportional coefficient $kp_{I,DRV}$ and an ohmic resistance $R_{I,DRV}$ of the pressure control valve 19. The output variable of the current controller 35 is a setpoint voltage $U_S$ for the pressure control valve 19, which is converted in a known way by reference to an operating voltage $U_B$ into a duty cycle for the pulse-width modulated signal PWMDRV for controlling the pressure control valve 19 and is fed to this in the normal function, i.e. when the second logic signal Z has the value 2. For current control, the current to the pressure control valve 19 is measured as the measured current variable $I_R$, is filtered in a current filter 37 and is fed back to the current controller 35 as a filtered actual current $I_I$.

As already indicated, the duty cycle PWMDRV of the pulse-width modeled signal for controlling the pressure control valve 19 is calculated from the setpoint voltage $U_S$ and the operating voltage $U_B$ in a well-known manner according to the following equation:

$$PWMDRV=(U_S/U_B)\times 100.$$

In this way, in the normal mode a high-pressure disturbance variable, namely the re-directed volumetric fuel flow VDRV, is generated via the pressure control valve 19 as the second pressure control element.

If the first logic signal SIG1 assumes the value "true", the first switching element 27 switches from the normal mode to the first operating mode of the protection region. The conditions under which this is the case are explained in connection with FIG. 4. With regard to the control of the pressure control valve 19, there is no difference in the first operating mode of the protection mode in this respect, as here too the pressure control valve 19 is controlled with the setpoint volumetric flow $V_S$, at least as long as the normal function is set by the second switching element 29. In this respect, there is no change to the previously given explanations to the right of the first switching element 27 in FIG. 2. However, the setpoint volumetric flow $V_S$ is calculated differently in the first operating mode of the protection mode than in the normal mode, namely by means of a second high pressure control circuit 39.

In this case, the setpoint volumetric flow $V_S$ is set identically to a limited output volumetric flow $V_R$ of a pressure control valve-pressure regulator 41. This corresponds to the upper switch position of the first switching element 27. The pressure control valve-pressure regulator 41 has a high-pressure control error $e_p$ as the input variable, which is calculated as the difference of the setpoint high pressure $p_S$ and the actual high pressure $p_I$. Further input variables of the pressure control valve-pressure regulator 41 are preferably a maximum volumetric flow $V_{max}$ for the pressure control valve 19, the setpoint volumetric flow $V_{S,ber}$ calculated in the calculation element 31 considering the function block B, and/or a proportional coefficient $kp_{DRV}$. The pressure control valve-pressure regulator 41 is preferably implemented as a $PI(DT_1)$ algorithm. In this case, preferably an integrating part (I-part) is initialized with the calculated setpoint volume current $V_S$ ignoring function block B at the time at which the first switching element 27 is switched from its lower switch position shown in FIG. 2 to its upper switch position $V_{S,ber}$. The I portion of the pressure control valve-pressure regulator 41 is limited upwards to the maximum volumetric flow $V_{max}$ for the pressure control valve 19. Here, the maximum volumetric flow $V_{max}$ is preferably an output variable of a two-dimensional characteristic 43, which has the maximum volumetric flow flowing through the pressure control valve 19 depending on the high pressure, wherein the characteristic 43 receives the actual high pressure $P_I$ as the input variable. The output variable of the pressure control valve-pressure regulator 41 is an unlimited volumetric flow $V_U$, which is limited in a limiting element 45 to the maximum volumetric flow $V_{max}$. The limiting element 45 finally outputs the limited setpoint volumetric flow $V_R$ as the output variable. The pressure control valve 19 is then controlled with this as the setpoint volumetric flow $V_S$, in that the setpoint volumetric flow $V_S$ is fed to the pressure control valve characteristic field 33 in the already described manner.

Control of the pressure control valve 19 as a pressure control element is thus carried out in this way in the first operating mode of the protection mode for controlling the high pressure in the high-pressure accumulator 13 by means of the second high pressure control circuit 39.

Figure 3:
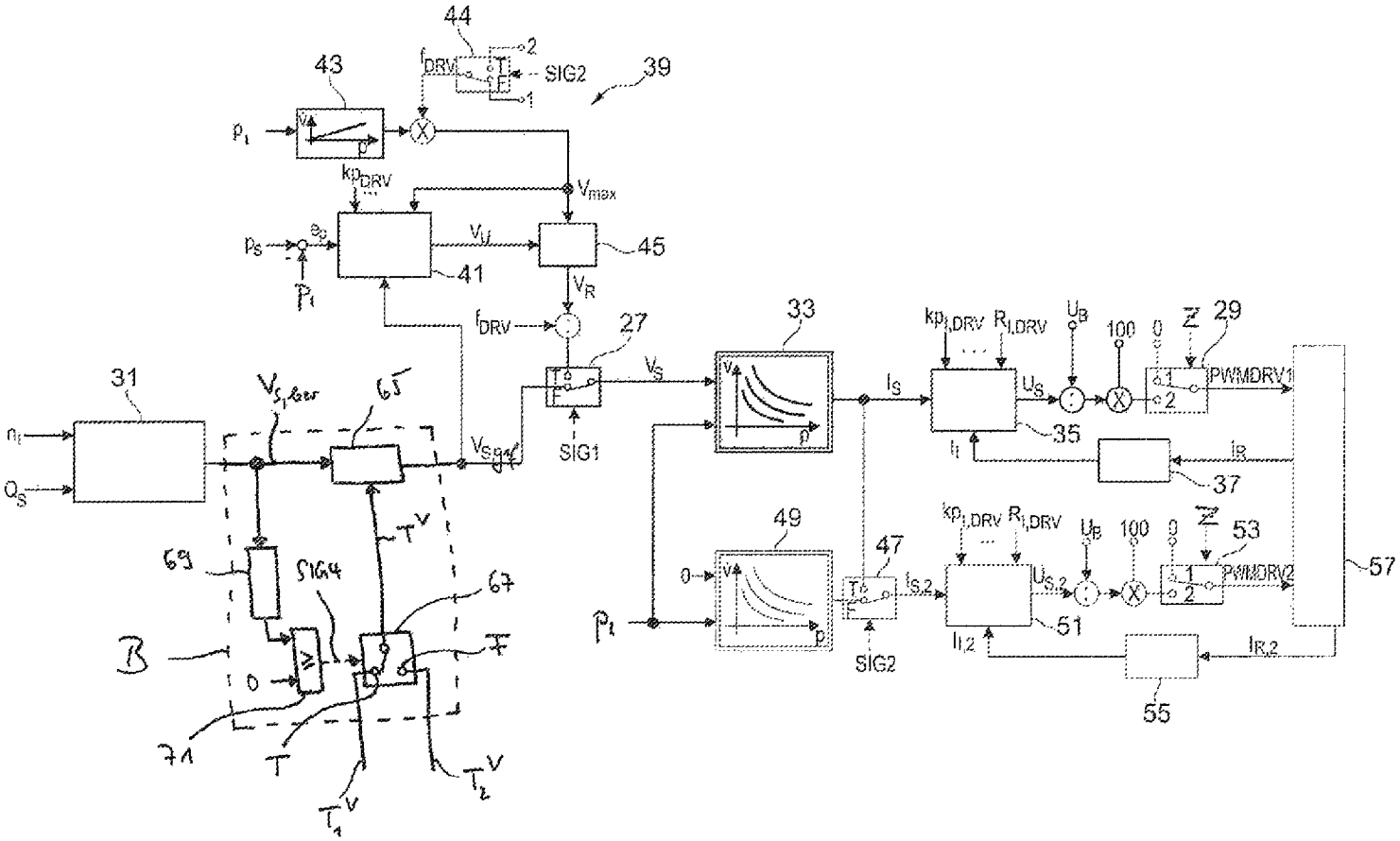
FIG. 3 shows a schematic detailed representation of a second embodiment of the method.

On the basis of FIG. 3, the method of operation is now described that results from the addition of a second pressure control valve 20 in an embodiment of the injection system 3 with two pressure control valves 19, 20. Here too, for better understanding function block B is at first ignored, wherein its significance and manner of operation are explained later. In this respect, the first step is to describe the manner of operation of the injection system 3 with two pressure control valves 19, 20 without the function block B. In particular, the differences between the control of two pressure control valves 19, 20 according to FIG. 3 as opposed to the control of only one pressure control valve 19 according to FIG. 2 are described below. In particular, with regard to the control of the first pressure control valve 19 or one of the pressure control valves 19, 20, reference is made to the preceding description as well as to the illustration according to FIG. 2. In particular, in FIG. 2 and FIG. 3, identical and functionally identical elements are provided with the same reference characters and/or labels, so that in this respect reference is made to the previous description.

As will be explained in more detail in connection with FIG. 4, the first logic signal SIG1 assumes the logical value "true" when the dynamic rail pressure $p_{dyn}$ reaches or exceeds a first pressure limit $p_{G1}$—for example due to a cable break of the suction throttle plug. As a result, the first switching element 27 changes to the upper switching position shown in FIG. 3, so that the high pressure is now controlled by means of the second high-pressure control circuit 39 and using one of the pressure control valves 19, 20. As will also be explained in connection with FIG. 4, a third logic signal SIG2 has the value "false" if the dynamic rail pressure $p_{dyn}$ has not yet reached a second pressure limit $P_{G2}$. A second pressure control valve setpoint current $I_{S,2}$ for a second pressure control valve 20, 19 is then read out via a third switching element 47 from a second pressure control valve control characteristic field 49, which has the actual high pressure $p_I$ and the constant value zero for the setpoint volumetric flow as input variables. If the two pressure control valves 19, 20 are of identical form, the second pressure control valve characteristic field 49 is equal to the first pressure control valve characteristic field 33 and differs only with regard to the incoming setpoint volumetric flow that is constantly set to zero. If different pressure control valves 19, 20 are used, the two pressure control valve characteristics 33, 49 may differ. Due to the fact that the second pressure control valve characteristic field 49 has a value of zero as the incoming setpoint volumetric flow, the pressure control valve 19, 20 is controlled in such a way as to be completely closed, wherein no fuel is re-directed into the fuel reservoir 7. The high pressure is therefore only controlled by means of one pressure control valve 19, 20 of the pressure control valves 19, 20 until the dynamic rail pressure $p_{dyn}$ reaches or exceeds the second pressure limit $p_{G2}$.

A fourth switching element 44 is provided, which determines the value of a factor $f_{DRV}$. This fourth switching element 44 is also controlled depending on the third logic signal SIG2 and adopts its lower switching position shown in FIG. 3 if the third logic signal SIG2 has the value "false". In this case, the output variable of the characteristic 43 is multiplied by a factor of 1. Accordingly, the limited setpoint volumetric flow $V_R$ resulting from the limit element 45 is divided by a factor of 1.

It is possible, moreover, that the same characteristic curve 43, and thus in particular only one characteristic curve 43, is used for both pressure control valves 19, 20 if the pressure control valves 19, 20 are of identical form. If the pressure control valves 19, 20 are of different forms, different characteristic curves 43 are preferably used for the different pressure control valves 19,20.

If the dynamic rail pressure $p_{dyn}$ increases and reaches or exceeds the second pressure limit $p_{G2}$, the third logic signal SIG2 assumes the value "true". This causes the third switching element 47 and the fourth switching element 44 to change into their upper switching position in FIG. 3. First considering the third switching element 47, this means that the second pressure control valve setpoint current $I_{S,2}$ in the specific embodiment shown here is identical to the first pressure control valve setpoint current $I_S$, so that as a result both pressure control valves 19, 20 are subjected to the same setpoint current. This in turn presupposes that the two pressure control valves 19, 20 are of identical form, which corresponds to a preferred embodiment. Of course, however, it is possible to subject the two pressure control valves 19, 20 to separate setpoint currents, in particular resulting from separate characteristic fields, if the pressure control valves 19, 20 differ. Thus, in particular the same pressure control valve characteristic field 33 is used for the pressure control valves 19, 20 if the two pressure control valves 19, 20 are of identical form. If, however, they differ, different pressure control valve characteristics may be used.

Two identical pressure control valves 19, 20 can re-direct twice the fuel intake compared to a single pressure control valve 19, 20. For this reason—now considering the fourth switching element 44—the factor $f_{DRV}$ now assumes the value 2, which causes the maximum volumetric flow $V_{max}$ resulting from the characteristic curve 43 to be doubled. On the other hand, the limited volumetric flow $V_R$ that results from the limiting element 45 is divided by the factor $f_{DRV}$ and thus now by two, since ultimately the resulting pressure control valve setpoint volumetric flow $V_S$ corresponds to a pressure control valve 19, 20 and is used respectively for the control of a pressure control valve 19, 20. This procedure is also adapted to the preferred embodiment, in which the two pressure control valves 19, 20 used are of the same form. If they are of different forms, on the other hand, preferably different characteristic curves 43, different second high-pressure control circuits 39, and different pressure control valve characteristic fields 33, 49 are used for controlling the different pressure control valves 19, 20. If, on the other hand, more than two pressure control valves 19, 20 of the same form are provided, these can be controlled completely analogously to the representation in FIG. 3 by a multiple of the control elements shown there for each pressure control valve 19, 20, wherein the number of the pressure control valves 19, 20 used can be used as the factor $f_{DRV}$ when the fourth switching element 44 is in the upper switching position.

The second pressure control valve setpoint current $I_{S,2}$ is the input variable of a second current controller 51, which is otherwise preferably the same as the first current controller 35. Also, the controller for generating the second control signal PWMDRV2 corresponds to that for the generation of the first control signal PWMDRV1 and of the single control signal PWMDRV according to FIG. 2, wherein a fifth switching element 53 is provided here for switching between the normal function and the standstill function, and wherein a second current filter 55 is provided for filtering a second measured current variable $I_{R,2}$, which has as an output variable a second actual current $I_{I,2}$, which is fed to the second current controller 51. The controller parameters of the second current controller 51 are preferably set the same as the corresponding parameters of the first current controller 35.

Using the second switching element 29 and the fifth switching element 53, it is apparent that the switch-on time of the control signals PWMDRV1, PWMDRV2 in the standstill function is identical to 0%. In the normal function, on the other hand, the respective control signal PWMDRV1, PWMDRV2 is generated by the controller assigned to it, as has already been explained.

The two control signals PWMDRV1, PWMDRV2 are preferably not fed directly to the pressure control valves 19, 20, but to a switching logic 57, which ensures that the pressure control valves 19, 20 are alternately controlled with the control signals PWMDRV1, PWMDRV2. Similarly, the measured current variables $I_R$, $I_{R,2}$ are preferably also taken from the switching logic 57, wherein this ensures that they are always measured on the respective pressure control valves 19, 20 correctly assigned to the control signals PWMDRV1, PWMDRV2 to ensure defined control of each of the pressure control valves 19, 20 by means of the current controllers 35, 51. By means of the switching logic 57, the load on the pressure control valves 19, 20 can be standardized in an advantageous manner, so that in particular none of the pressure control valves 19, 20 is controlled much more frequently than the other.

Figure 4:
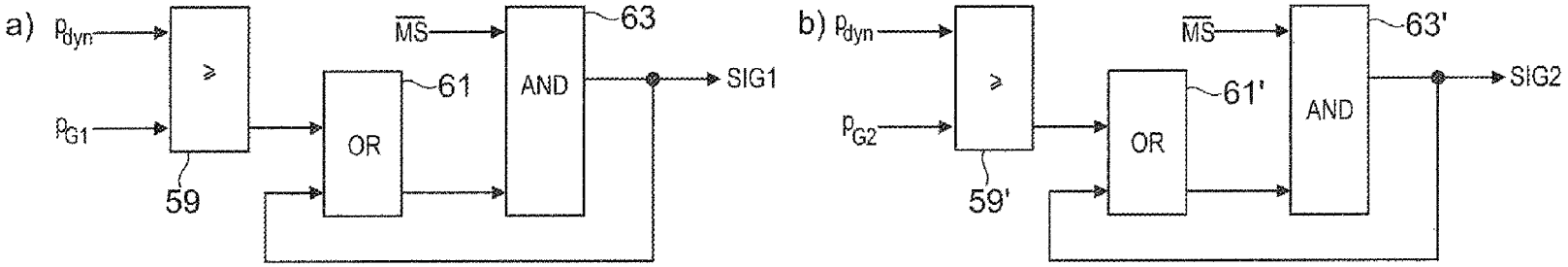
FIG. 4 shows a further schematic detailed presentation of the method.

FIG. 4 shows the conditions under which the first logic signal SIG1 and the third logic signal SIG2 each assume the values "true" and "false".

This is shown below first using FIG. 4*a*) for the first logic signal SIG1. The following explanations for the first logic signal SIG1 apply both to the embodiment of the injection system with only one pressure control valve 19 according to FIG. 2 and to the embodiment of the injection system 3 with two pressure control valves 19, 20 according to FIG. 3. As long as the dynamic rail pressure $p_{dyn}$ does not reach or exceed a first pressure limit $p_{G1}$, the output of a first comparator element 59 has the value "false". When the internal combustion engine 1 is started, the value of the first logic signal SIG1 is initialized with "false". As a result, the result of a first OR element 61 is "false" as long as the output of the first comparator element 59 is "false". The output of the first OR element 61 is fed to an input of a first rounding element 63, the other input of which is fed by a negation of a variable MS indicated by a transverse line, where the variable MS has the value "true" if the internal combustion engine 1 is not running, and where it has the value "false" if the internal combustion engine 1 is running. When the internal combustion engine 1 is running, therefore, the value of the negation of the variable MS is "true". Overall, it is now clear that the output of the rounding element 63 and thus the value of the first logic signal SIG1 is "false" as long as the dynamic rail pressure $p_{dyn}$ does not reach or exceed the first pressure limit $p_{G1}$. If the dynamic rail pressure $p_{dyn}$ reaches or exceeds the first pressure limit $p_{G1}$, the output of the first comparator element 59 jumps from "false" to "true". Thus, the output of the first OR element 61 also jumps from "false" to "true". If the internal combustion engine is running 1, the output of the first rounding element 63 also jumps from "false" to "true", so that the value of the first logic signal SIG1 becomes "true". This value is fed back to the first OR element 61, but this does not change the fact that its output remains "true". Even a drop in the dynamic rail pressure $p_{dyn}$ to below the first pressure limit $p_{G1}$ can no longer change the "true" value of the first logic signal SIG1. On the contrary, this remains "true" until the variable MS and thus its negation changes its true/false value, namely when the internal combustion engine 1 is no longer running. This shows the following: the normal mode is carried out as long as the dynamic rail pressure $p_{dyn}$ is below the first pressure limit $p_{G1}$. In this case, the setpoint volumetric flow $V_S$—ignoring the function block B—is identical to the calculated setpoint volumetric flow $V_{S,ber}$. If the dynamic rail pressure $p_{dyn}$ reaches or exceeds the first pressure limit $p_{G1}$, the first logic signal SIG1 assumes the value "true", and the first switching element 27 adopts its upper switching position. Thus in this case, the setpoint volumetric flow $V_S$ becomes identical to the limited volumetric flow $V_R$ of the second high pressure control circuit 39—if necessary down to the factor $f_{DRV}$. This means that that in the normal mode a high-pressure disturbance variable is generated by the at least one pressure control valve 19, 20. The high pressure is always controlled by the pressure control valve-pressure regulator 41 whenever the dynamic rail pressure $p_{dyn}$ reaches the first pressure limit pc for the first time, and then until standstill of the internal combustion engine 1 is detected. In the first operating mode of the protection mode, therefore, at least one pressure control valve 19, 20 takes over control of the high pressure by means of the second high pressure control circuit 39.

In FIG. 4*b*) the logic for switching the third logic signal SIG2 for the exemplary embodiment of the injection system 3 with two pressure control valves 19, 20 is shown.

This shows that this fully corresponds to the logic for switching the first logic signal SIG1, excepting only that the second pressure limit $p_{G2}$ is used as the input variable instead of the first pressure limit $p_{G1}$. The corresponding logic switching components are provided with cancelled reference characters here in comparison with FIG. 4*a*). Due to the completely identical manner of operation, the explanations for FIG. 4*a*) are referred to. Analogously to the first logic signal SIG1, the third logic signal SIG2 exhibits the following: it is initialized with the value "false" at the start of operation of the internal combustion engine 1, changing its logical value to "true" when the dynamic rail pressure $p_{dyn}$ reaches or exceeds the second pressure limit $P_{G2}$. As a result, the truth value "true" of the third logic signal SIG2 is detected until standstill of the internal combustion engine 1 is detected.

With reference to FIG. 3, it appears that the second operating mode of the protection mode is activated when the third logic signal SIG2 changes its truth value from "false" to "true", in which case the previously inactive pressure control valve 20, 19 is switched on, so that the high pressure is controlled by both pressure control valves 19, 20.

Returning to FIGS. 2 and 3, the third operating mode of the protection mode is explained below: This is the operating mode which is switched to when the second logic signal Z assumes the value 1. In this case, the second switching element 29 and, if necessary, the fifth switching element 53 is/are brought into the upper switching position shown in FIGS. 2 and 3, wherein the standstill function is set for the pressure control valves 19, 20. In this standstill function, the pressure control valves 19, 20 are no longer controlled, i.e. the control signals PWMDRV, PWMDRV1, PWMDRV2 are set to zero. Since preferably at least one pressure control valve 19, 20 that is normally open under input pressure is used, they now continuously re-direct a maximum volumetric fuel flow from the high-pressure accumulator 13 into the fuel reservoir 7.

If, on the other hand, the second logic signal Z has a value of 2, then—as already explained—the normal function is set for the pressure control valves 19, 20 and these are controlled with their respective setpoint currents $I_S$, $I_{S,2}$ and the control signals PWMDRV, PWMDRV1, PWMDRV2 calculated therefrom.

Figure 5:
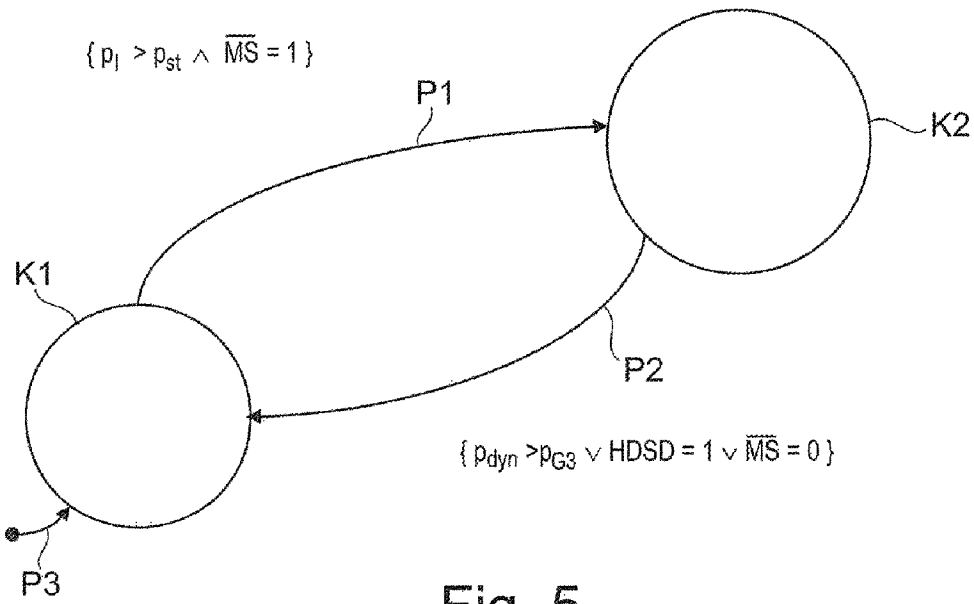
FIG. 5 shows a further schematic detailed presentation of the method.

FIG. 5 shows schematically a state transition diagram for the pressure control valves 19, 20 from the normal function to the standstill function and back for an embodiment of the injection system 3 with two pressure control valves 19, 20. However, exactly the same logic arises for the embodiment of the injection system 3 with only one pressure control valve 19—except for the fact that then there are not three different pressure limits, but only two pressure limits must be taken into account, namely the first pressure limit $p_{G1}$ and the third pressure limit $P_{G3}$. Furthermore, then of course, wherever reference is made below to the two pressure control valves 19, 20 in connection with FIG. 5, only one pressure control valve 19 must be assumed.

The pressure control valves 19, 20 are preferably designed in such a way that they are closed when unpressurized and deenergized, wherein they are further preferably embodied so that they are closed under an inlet-side pressure up to an opening pressure value, wherein they open when the inlet-side pressure reaches or exceeds the opening pressure value in the deenergized state. They are thus normally open when under input pressure and can be controlled towards the closed state by energizing. The opening pressure value may be 850 bar, for example.

In FIG. 5 at the bottom left, the standstill function is symbolized by a first circle K1, wherein the normal function is symbolized with a second circle K2 at the upper right. A first arrow P1 represents a transition between the standstill function and the normal function, wherein a second arrow P2 represents a transition between the normal function and the standstill function. With a third arrow P3, initialization of the internal combustion engine 1 after switching on the control unit is indicated, wherein the pressure control valves 19, 20 are initialized first in the standstill function. Only when ongoing operation of the internal combustion engine 1 is detected at the same time, and the actual high-pressure $p_I$ exceeds a predetermined starting value $p_{Start}$, the normal function is set for the pressure control valves 19, 20—along the arrow PI—and the standstill function is reset, in particular by the second logic signal Z changing its value from 1 to 2. The normal function is reset and the standstill function is set along the arrow P2 if the dynamic rail pressure $p_{dyn}$ exceeds the third pressure limit $p_{G3}$, or if a defect of a high pressure sensor—here represented by a logic variable HDSD—is detected, or when it is detected that the internal combustion engine 1 is at a standstill. In the standstill function, in which the second logic signal Z again assumes the value 1, the pressure control valves 19, 20 are not controlled, wherein they are controlled by means of the respective assigned setpoint currents Is, $Is_{,2}$ in the normal function—as already explained in connection with FIG. 3.

The following functionality results: If the internal combustion engine 1 starts, there is initially no high pressure in the high-pressure accumulator 13, and the pressure control valves 19, 20 are arranged in their standstill function, so that they are pressureless and deenergized, i.e. closed. When the internal combustion engine 1 runs up, therefore, a high pressure can quickly build up in the high-pressure accumulator, which at some point exceeds the starting value $p_{Start}$. This is preferably lower than the opening pressure value of the pressure control valves 19, 20, so that the normal function is first set for the valves 19, 20 before they open. This ensures in an advantageous way that the pressure control valves 19, 20 are controlled in any case when they open for the first time. Since they are closed when not pressurized, they remain closed even under control until the actual high pressure $p_I$ also exceeds the opening pressure value, wherein they are then opened and controlled in the normal function, namely either in the normal mode or in the first operating mode of the protection mode.

However, if one of the cases described above occurs, the standstill function is again set for the pressure control valves 19, 20.

This is particularly the case when the dynamic rail pressure $p_{dyn}$ exceeds the third pressure limit $p_{G3}$, wherein this is preferably greater than the first pressure limit $p_{G1}$ and the second pressure limit $p_{G2}$, and in particular has a value at which a mechanical overpressure valve would open in a conventional design of the injection system. Since the pressure control valves 19, 20 are normally open under pressure, they open completely in the standstill function in this case and thus safely and reliably fulfil the function of an overpressure valve.

The transition from the normal function to the standstill function also occurs when a defect is detected in the high pressure sensor 23. If there is a defect, the high pressure in the high-pressure accumulator 13 can no longer be controlled. In order to be able to operate the internal combustion engine 1 safely, the transition from the normal function to the standstill function for the pressure control valves 19, 20 is caused, so that they open and thus prevent an unacceptable increase of the high pressure.

Furthermore, the transition from the normal function to the standstill function takes place in a case in which a standstill of the internal combustion engine 1 is detected. This corresponds to a reset of the pressure control valves 19, 20, so that when the internal combustion engine 1 is restarted, the cycle described here can start again.

If the standstill function is set for the pressure control valves 19, 20 under pressure in the high-pressure accumulator 13, the valves are open to the maximum extent and re-direct a maximum volumetric flow from the high-pressure accumulator 13 into the fuel reservoir 7. This corresponds to a protective function for the internal combustion engine 1 and the injection system 3, wherein in particular this protective function can replace the lack of a mechanical overpressure valve.

It is important here that the pressure control valves 19, 20 have only two functional states, namely the standstill function and the normal function, wherein these two functional states are fully sufficient to cover the entire relevant functionality of the pressure control valves 19, 20 including the protective function for replacing a mechanical overpressure valve.

It turns out that even after exceeding the second pressure limit value $p_{G2}$, stable control of the high pressure by means of the pressure control valves is still possible, since the conveying capacity of the high-pressure pump 11 depends on the speed. In this case, engine operating values, especially emission values, can still be complied with. Only in the higher speed range must the third pressure limit value $p_{G3}$ be expected to be exceeded. In this case, the pressure control valves 19, 20 open completely and a deterioration in engine operating values, especially emissions, must be expected. At least stable operation of the engine is then still guaranteed.

Even in the event of a failure of the high pressure sensor 23, stable engine operation is still possible, even if in this case a deterioration of the engine operating values occurs, in particular the emission values.

The fact that the second pressure limit $P_{G2}$ is greater than the first pressure limit $p_{G1}$ avoids both pressure control valves 19, 20 simultaneously transitioning from the closed state to an open state. In this way, large pressure gradients that could have a harmful effect on the injection system 3 are avoided.

The manner of operation of function block B is explained below with reference to FIGS. 2 and 3:

In the event of a reduction of the load on the internal combustion engine 1, in particular in the event of a sudden complete load reduction from a full load state, the high pressure in the high-pressure accumulator 13 first increases, since the amount of fuel to be injected into the combustion chambers 16 of the internal combustion engine 1 is quickly reduced, wherein the high-pressure controller only responds with a delay. At the same time as the load is reduced, a setpoint speed is typically reduced to an idling speed, especially in the form of a ramp. The current engine speed $n_I$ initially overshoots and finally approaches the setpoint speed from above. The setpoint injection quantity $Q_S$ decreases very quickly—especially to zero—with the increase of the engine speed $n_I$ in the form of the overshoot after the load reduction. If the setpoint injection quantity $Q_S$ falls to very small values, the setpoint volumetric flow $V_{s,ber}$ calculated by the calculation element 31 increases again quickly—in particular up to a maximum value of preferably 2 l/min. If the engine speed $n_I$ then falls below the setpoint speed, a positive speed control error results. This causes the setpoint injection quantity $Q_S$ to increase again. An increasing setpoint injection quantity $Q_S$ in turn leads to a decrease of the calculated setpoint volumetric flow $V_{s,ber}$, in particular to the value 0 l/min. If this occurs very quickly, the associated very fast reversal of the volumetric fuel flow VDRV, which is re-directed in the normal mode via the pressure control valve 19, leads to a significant abrupt increase in the actual high pressure $p_I$, for example by about 500 bar. A very rapid reduction of the volumetric fuel flow VDRV re-directed via the pressure control valve 19 thus leads to a sudden sharp increase in the actual high pressure $p_I$. As a result, the internal combustion engine 1 can be subjected to unduly heavy loads on the one hand, and on the other hand the engine's emission behavior deteriorates due to the large deviation from the setpoint high pressure $p_S$. While a rapid increase of the setpoint volumetric flow $V_S$ that is used in the normal mode to control the pressure control valve 19 is desired in the case of an excessively high actual high pressure $p_I$, a similarly dynamic decrease of the setpoint volumetric flow $V_S$ is undesirable for the reasons explained above. According to FIGS. 2 and 3 however, the setpoint volumetric flow $V_S$ behaves the same in both situations in the normal mode—ignoring function block B—especially with the same dynamics.

In order to solve the previously described problem, an embodiment according to the invention of the method for operating the internal combustion engine 1 with the injection system 3 and the high-pressure accumulator 13 provides that the high pressure in the high-pressure accumulator 13 is controlled via the low-pressure suction throttle 9 as the first pressure control element in the first high-pressure control circuit, wherein in the normal mode the high-pressure disturbance variable VDRV is generated via at least one first pressure control valve 19 on the high pressure side as a further pressure control element which re-directs fuel from the high-pressure accumulator 13 into the fuel reservoir 7, wherein the pressure control valve 19 is controlled in the normal mode on the basis of the setpoint volumetric flow $V_S$ for the fuel to be re-directed, wherein a variation with time of the setpoint volumetric flow is detected, wherein the setpoint volumetric flow is filtered, wherein a time constant for the filtering of the setpoint volumetric flow is selected depending on the detected variation with time of the setpoint volumetric flow.

In particular, the variation with time of the calculated setpoint volumetric flow $V_{S,ber}$ is detected in function block B, and this is filtered with a time constant that depends on the detected variation with time. For this purpose, function block B comprises a volumetric flow filter 65, into which the calculated setpoint volumetric flow $V_{S,ber}$ is input. Furthermore, a time constant $T^V$ for filtering the calculated setpoint volumetric flow $V_{S,ber}$ is input to the setpoint volumetric flow filter 65.

The setpoint volumetric flow filter 65 is preferably embodied as a proportional filter with a delay element, in particular as a $PT_1$ filter, the transmission function of which is in particular:

$$G(s)=1/(1+T^V s).$$

The time constant $T^v$ is freely selectable.

A sixth switching element 67 determines the value that the time constant $T^V$ adopts depending on a fourth logic signal SIG4. If the value of the fourth logic signal SIG4 is "true" (T), the sixth switching element 67 adopts its left switch position shown in FIG. 2, and the time constant $T^v$ is assigned a first value $T_1{}^V$. If this fourth logic signal SIG4 adopts the value "false" (F), on the other hand, the sixth switching element 67 adopts the right switch position, and the time constant $T^V$ is assigned a second value $T_2{}^V$.

The value of the fourth logic signal SIG4 is determined by calculating a—preferably averaged—time derivative of the calculated setpoint volumetric flow $V_{S,ber}$ in a differentiating element 69, wherein the time constant $T^V$ is thus selected depending on the preferably averaged time derivative.

For this purpose, the preferably averaged time derivative as the output variable of the differentiating element 69 is fed to a second comparator element 71, which besides the time derivative determined by the differentiating element 69 also has the constant value zero as an input variable. The preferably averaged time derivative of the setpoint volumetric flow $V_{S,ber}$ is therefore compared in the second comparator element 71 in particular with zero. The second comparator element 71 has the fourth logic signal SIG4 as the output variable. This assumes the value "true" if the time derivative resulting from the differentiating element 69 is greater than or equal to zero. It assumes the value "false" if the time derivative resulting from the differentiating element 69 is less than zero.

Therefore, the first value $T_1^V$ is selected for the time constant $T^V$ if the time derivative has a positive sign or is equal to zero, wherein the second value $T_2^V$ is selected for the time constant $T^V$ if the time derivative has a negative sign.

The values $T_1^V$, $T_2^V$ for the time constant $T^V$ are now selected in particular in such a way that the variation with time of the setpoint volumetric flow $V_S$ is delayed when it decreases, wherein at the same time it is not delayed or is only slightly delayed when the setpoint volumetric flow $V_S$ and in particular the calculated setpoint volumetric flow $V_{S,ber}$ increases. For this purpose, the first value $T_1^V$ is preferably selected as zero, wherein the second value $T_2^V$ is preferably greater than zero, so it is really chosen as positive. Thus, there are different values for the time constant $T^V$ for increasing and decreasing setpoint volumetric flow $V_S$, wherein the decreasing setpoint volumetric flow $V_S$ is delayed in time, wherein an increasing setpoint volumetric flow $V_S$ is not delayed in time as far as possible. The second value $T_2^V$ is preferably selected from at least 0.1 s to a maximum of 1.1 s, preferably from at least 0.2 s to a maximum of 1 s.

From the setpoint volumetric flow filter 65 and thus from the function block B, a filtered setpoint volumetric flow $V_{S,gef}$ results, which in the normal mode is set equal to the setpoint volumetric flow $V_S$. This filtered setpoint volumetric flow $V_{S,gef}$ is preferably also fed to the pressure control valve-pressure regulator 41 as an input variable.

The manner of operation of the function block B for the exemplary embodiment of the injection system 3 with two pressure control valves 19, 20 according to FIG. 3 is identical to the manner of operation described with reference to FIG. 2. Reference is therefore made to the previous description in that regard.

A particularly advantageous calculation of an average gradient $Gradient_{Mittel}^V$ as an averaged time derivative of the calculated setpoint volumetric flow $V_{S,ber}$ of the calculation element 31 is described: a current gradient $Gradient_{Aktuell}^V(t_1)$ of the calculated setpoint volumetric flow $V_{S,ber}$ at time $t_1$ is calculated by subtracting the value $V_{S,ber}(t_1-\Delta t_{Grad}^V)$, which precedes the current value by the time span $\Delta t_{Grad}^V$, from the current value $V_{S,ber}(t_1)$ and dividing the difference by the time span $\Delta t_{Grad}^V$. The gradient at time $(t_1-Ta)$, wherein Ta denotes a sample time, is calculated in that the value $V_{S,ber}(t_1-\Delta t_{Grad}^V-Ta)$, which precedes the current value by the time span $\Delta t_{Grad}^V$, is subtracted from the value $V_{S,ber}(t_1-Ta)$ and the difference is also divided by the time span $\Delta t_{Grad}^V$. Entirely generally, the gradient of the setpoint volumetric flow $V_{S,ber}$ at time $(t_1-(k-1)Ta)$ is calculated by subtracting the value $V_{S,ber}(t_1-\Delta t_{Grad}^V-(k-1)Ta)$, which precedes the current value by the time span $\Delta t_{Grad}^V$, from the value $V_{S,ber}(t_1-(k-1)Ta)$ and dividing the difference by the time span $\Delta t_{Grad}^V$.

It is an advantageous embodiment of the calculation of the average gradient if this is averaged over a predeterminable period of time $\Delta t_{Mittel}^V$. For a sampling time Ta, the averaged gradient $Gradient_{Mittel}(t_1)$ results at time $t_1$ by averaging over a total of k gradients, wherein the number k is calculated as follows:

$$k=\Delta t_{Mittel}^V/Ta.$$

Figure 6:
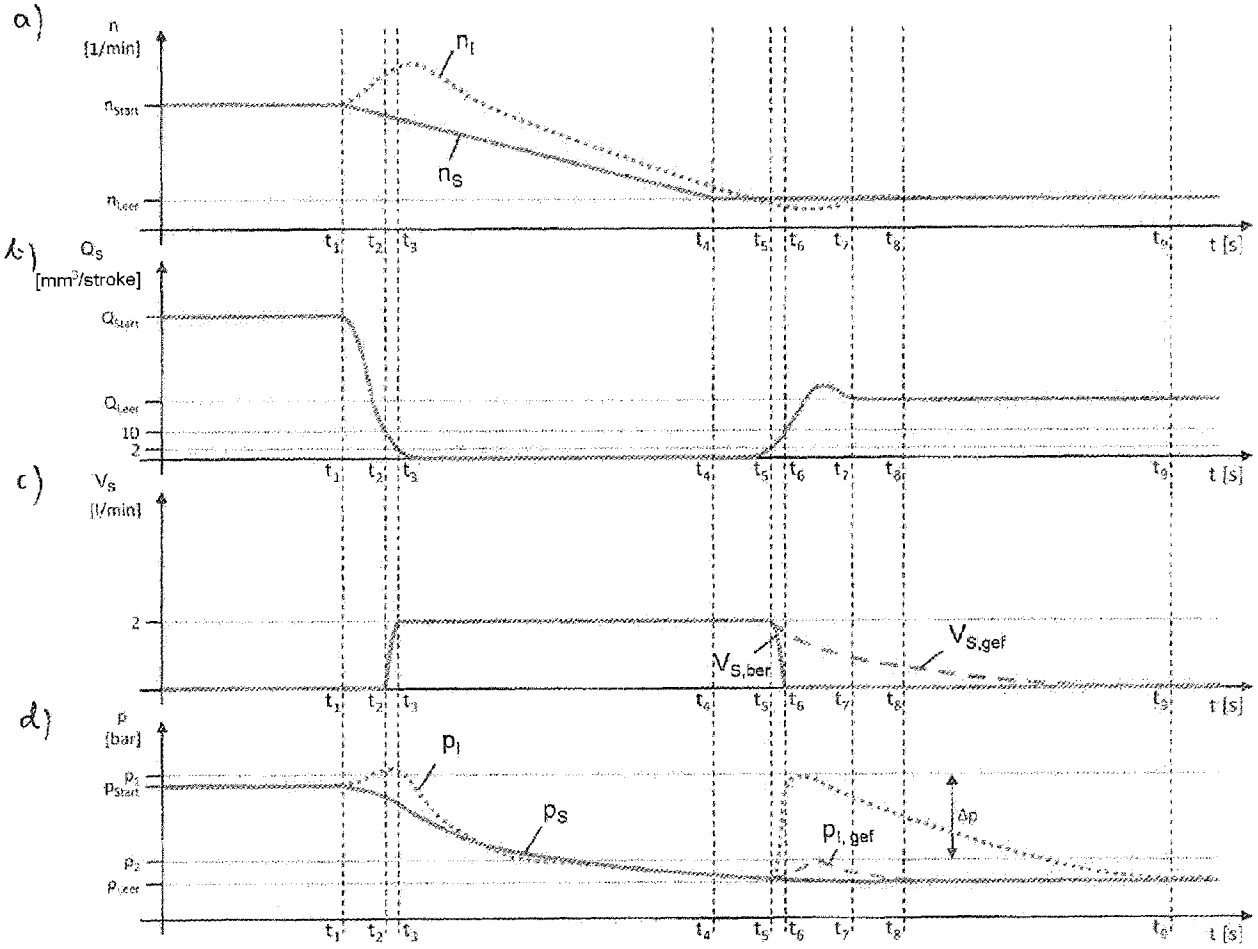
FIG. 6 shows a schematic representation of the effects arising in association with the method.

FIG. 6 shows a schematic representation of the effects resulting in connection with the method, in particular in the form of four timing diagrams. A first timing diagram at a) shows the engine setpoint speed $n_S$ as a solid line and the actual engine speed $n_I$ as a dotted line. Up to a first time $t_1$, the setpoint engine speed $n_S$ is identical to the constant value $n_{Start}$. From the first time $t_1$ to a fourth time $t_4$, the setpoint engine speed $n_S$ drops from the value $n_{Start}$ to an idling speed $n_{Leer}$. Subsequently, the setpoint engine speed $n_S$ remains unchanged. The actual engine speed $n_I$ increases to the first time $t_1$ and approaches the setpoint engine speed ns then, until finally the setpoint engine speed $n_S$ and the actual engine speed $n_I$ are identical at a seventh time $t_7$.

A second timing diagram at b) shows the setpoint injection quantity $Q_S$. Up to the first time $t_1$, the setpoint injection quantity $Q_S$ is identical to the constant value $Q_{Start}$. Since the actual engine speed $n_I$ then increases above the setpoint engine speed $n_S$, the setpoint injection quantity $Q_S$ subsequently decreases. At a second time $t_2$, the setpoint injection quantity $Q_S$ reaches the value 10 $mm^3$/stroke and at a third time $t_3$ reaches the value 2 $mm^3$/stroke. Since the actual engine speed $n_I$ runs above the setpoint engine speed $n_S$ from then on, the setpoint injection quantity $Q_S$ falls to the value 0 $mm^3$/stroke and remains at this value until the actual engine speed $n_I$ falls below the setpoint engine speed $n_S$. If this is the case, the setpoint injection quantity $Q_S$ increases again and reaches the value 2 $mm^3$/stroke again at a fifth time $t_5$. At a sixth time $t_6$, the setpoint injection quantity $Q_S$ again reaches the value 10 $mm^3$/stroke, and at a seventh Time $t_7$, this has settled at an idling injection setpoint quantity $Q_{Leer}$.

A third timing diagram at c) shows the calculated setpoint volumetric flow $V_{S,ber}$ as a solid line, and the filtered setpoint volumetric flow $V_{S,gef}$ as a dashed line. For example, the calculated setpoint volumetric flow $V_{S,ber}$ is identical to 0 l/min when the setpoint injection quantity $Q_S$ is greater than or equal to 10 $mm^3$/stroke. As a result, both $V_{S,ber}$ and $V_{S,gef}$ are identical to 0 1/min up to the second time $t_2$. From the second time $t_2$ to the third time $t_3$, the setpoint injection quantity $Q_S$ falls from the value 10 $mm^3$/stroke to the value 2 $mm^3$/stroke. This causes the calculated setpoint volumetric flow $V_{S,ber}$ e to rise from the value 0 l/min to the value 2 l/min. As the first value $T_1^V$ for the time constant $T^V$ is identical to 0 s for increasing setpoint volumetric flow, the input variable $V_{S,ber}$ of the setpoint volumetric flow filter 65 is not delayed and is thus identical to the output variable $V_{S,gef}$ of the setpoint volumetric flow filter 65. From the third time $t_3$ to the fifth time $t_5$, the setpoint injection quantity $Q_S$ is less than or equal to 2 $mm^3$/stroke. This results in a constant input variable $V_{S,ber}$ of the setpoint volumetric flow filter 65 of 2 1/min. Since the time constant $T^V$ is also identical to 0 s in this case, the output variable $V_{S,gef}$ of the setpoint volumetric flow filter 65 is also identical in this case to the input variable $V_{S,ber}$ of the setpoint volumetric flow filter 65 and is thus constant at 2 1/min. From the fifth time $t^5$ to the sixth time $t_6$, the setpoint injection quantity $Q_S$ increases from 2 $mm^3$/stroke to 10 $mm^3$/stroke. Subsequently, the setpoint injection quantity $Q_S$ continues to increase and finally settles at the idling setpoint injection quantity $Q_{Leer}$. The input variable $V_{S,ber}$ of the setpoint volumetric flow filter 65 thus drops from the value 2 1/min to the value 0 1/min from the fifth time $t_5$ to the sixth time $t_6$. $V_{S,ber}$ then remains at the value 0 1/min. Since the second value $T_2^V$ for the time constant $T^V$ for the decreasing pressure control valve setpoint volumetric flow is greater than 0 s and typically adopts values from 0.2 to 1 s, the output variable $V_{S,gef}$ of the setpoint volumetric flow filter 65 drops from the fifth time $t_5$ with a time delay and finally approaches the input variable $V_{S,ber}$ of the volumetric flow filter 65 and thus the value 0 1/min. This is represented in the form of a dashed line.

A fourth timing diagram at d) shows the setpoint high pressure $p_S$ as a solid line. This is identical to a starting value $p_{Start}$ until the first time $t_1$. After the first time $t_1$, the setpoint high pressure $p_S$ drops and finally settles at an idle value $p_{Leer}$ at the seventh time $t_7$. A dotted line shows the course of the actual high pressure $p_I$ without the function block B. From the first time $t_1$, the actual high pressure $p_I$ initially increases and subsequently approaches the setpoint high pressure $p_{Soll}$ due to the re-direction of fuel using the pressure control valve 19, 20. At the fifth time $t_5$ there is a significant increase in the actual high pressure $p_I$. This is due to the reversal of the fuel that is to be re-directed via the pressure control valve 19, 20. At first, the actual high pressure $p_I$ rises very quickly to a first maximum value $p_I$. Subsequently, the actual high pressure $p_I$ slowly approaches the setpoint high pressure $p_S$ again and is identical to this at a ninth time $t_9$. The lack of a fuel re-direction amount is responsible for the slower decrease of the actual high pressure $p_I$. The course of the actual high pressure $p_{I,gef}$ when using function block B is shown dashed. Since, when selecting a first value, $T_1^V$ of the time constant $T^V$ of 0 s, this effect only occurs if the input variable $V_{S,ber}$ of the setpoint volumetric flow filter 65 decreases, this effect only takes place from the fifth time $t_5$. Since the filtering leads to the setpoint volumetric flow $V_S$ to be re-directed falling more slowly, there is only a small increase in the actual high pressure $p_{I,gef}$. In this case, a second maximum value $p_2$ is reached. In addition, the actual high pressure $p_{I,gef}$ is already settled at the setpoint high pressure $p_S$ sooner, at an eighth time $t_8$. The filtering thus makes it possible to reduce the increase of the actual high pressure $p_I$ by the difference value $\Delta p$. In practice, $\Delta p$ is 300 to 400 bar.

Figure 7:
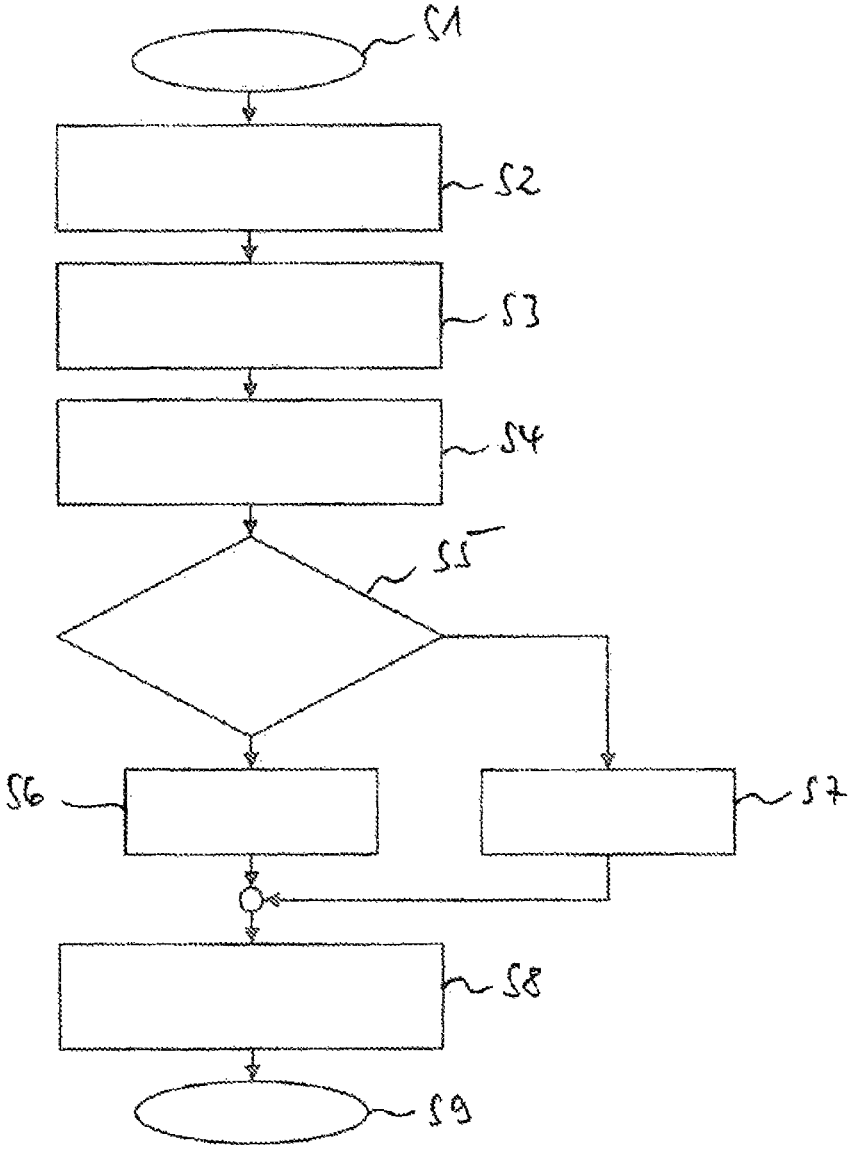
FIG. 7 shows a schematic detailed representation of the method in the form of a flowchart.

FIG. 7 shows a schematic detailed representation of the method in the form of a flowchart.

The method is started in a first step S1. In a second step S2, the calculated setpoint volumetric flow $V_{S,ber}$ is calculated by the calculation element 31. In a third step S3, a current time derivative of the calculated setpoint volumetric flow $V_{S,ber}$ is calculated. In a fourth step S4, an averaged time derivative of the calculated setpoint volumetric flow $V_{S,ber}$ is calculated. In a fifth step S5, a check is made as to whether the averaged time derivative is greater than or equal to zero. If this is the case, the first value $T_1^V$ is assigned to the time constant $T^V$ in a sixth step S6. If this is not the case, the second value $T_2^V$ is assigned to the time constant $T^V$ in a seventh step S7. In an eighth step S8, the calculated setpoint volumetric flow $V_{S,ber}$ is filtered by the setpoint volumetric flow filter 65 with the time constant $T^V$, resulting in the filtered setpoint volumetric flow $V_{S,gef}$. The method ends in a ninth step S9. The method is preferably carried out continuously, at least in the normal mode permanently during the operation of the internal combustion engine 1. It therefore starts again, especially in the first step S1, when it is in the ninth Step S9.

The invention has the following advantages:

In the stationary mode—especially at constant speed and constant load on the internal combustion engine 1—advantageously no fuel is re-directed by the pressure control valve 19, 20, since such re-direction would worsen the efficiency of the internal combustion engine 1. However, if a load reduction occurs, the invention in particular allows a very rapid increase in the re-direction amount of the pressure control valve 19, 20, whereby the high pressure overshoot is effectively reduced.

If the transition to the stationary mode is carried out again after the load has been reduced, the re-direction amount must be reduced back to zero. The invention allows in particular slowing down of the reversal of the re-direction amount in order to reduce the resulting increase in the high pressure. At the same time, the high pressure settles back to its setpoint value more quickly.

In both cases, the invention in particular allows the reduction of significant increases in the high pressure. This improves the emission behavior of the internal combustion engine 1 and prevents undue loads as a result of excessive rail pressures.

The invention claimed is:

1. A method for operating an internal combustion engine, with an injection system having a high-pressure accumulator, comprising the steps of: controlling a high pressure in the high-pressure accumulator by a low-pressure suction throttle as a first pressure control element in a first high-pressure control circuit; generating, in a normal mode, a high pressure disturbance variable via at least one first high-pressure side pressure control valve as a further pressure control element, via which fuel from the high-pressure accumulator is re-directed into a fuel reservoir; controlling, in the normal mode, the least one pressure control valve based on a setpoint volumetric flow for the fuel to be re-directed; detecting a variation over time of the setpoint volumetric flow; filtering the setpoint volumetric flow; and selecting a time constant for the filtering of the setpoint volumetric flow depending on the detected variation over time.

2. The method according to claim 1, including calculating a time derivative of the setpoint volumetric flow, wherein the time constant is selected depending on the time derivative.

3. The method according to claim 2, wherein the time derivative is averaged.

4. The method according to claim 2, including selecting a first value for the time constant when the time derivative has a positive sign or is equal to zero, and selecting a second value for the time constant when the time derivative has a negative sign.

5. The method according to claim 4, including selecting the first value for the time constant to be equal to zero, and selecting the second value for the time constant to be greater than zero.

6. The method according to claim 5, including selecting the second value for the time constant to be from at least 0.1 s to a maximum of 1.1 s.

7. The method according to claim 6, including selecting the second value for the time constant to be from 0.2 s to a maximum of 1 s.

8. The method according to claim 1, including filtering the setpoint volumetric flow with a proportional filter with a delay element.

9. The method according to claim 8, including filtering the setpoint volumetric flow with a $PT_1$ filter.

10. The method according to claim 1, wherein:

a) in a first operating mode of a protection operation the high pressure is controlled using the at least one first pressure control valve by way of a second high pressure control circuit, and/or b) in a second operating mode of the protection operation at least one second pressure control valve on the high pressure side, which is different from the at least one first pressure control valve, is controlled in addition to the at least one first pressure control valve as a pressure control element for controlling the high pressure by way of the second high pressure control circuit, and/or c) in a third operating mode of the protection operation, the at least one pressure control valve is continuously opened.

11. An injection system for an internal combustion engine, comprising:

a fuel reservoir;

a high-pressure pump;

at least one injector;

a high-pressure accumulator that has a fluid connection to the at least one injector and via the high-pressure pump to the fuel reservoir;

a suction throttle assigned to the high-pressure pump as a first pressure control element;

at least one pressure control valve, via which the high-pressure accumulator is fluidically connected to the fuel reservoir; and a control unit connected to the at least one injector, the suction throttle and the at least one pressure control valve, wherein the control unit is configured to carry out the method according to claim 1.

12. The injection system according to claim 11, wherein the at least one pressure control valve is normally open.

13. An internal combustion engine comprising: at least one combustion chamber; and an injection system according to claim 11.

* * * * *